US011689863B2

(12) United States Patent
Sun

(10) Patent No.: US 11,689,863 B2
(45) **Date of Patent: *Jun. 27, 2023**

(54) MEMS MICROPHONE AND METHOD OF MANUFACTURING THE SAME

(71) Applicant: DB HITEK CO., LTD., Seoul (KR)

(72) Inventor: Jong Won Sun, Icheon-si (KR)

(73) Assignee: DB HITEK CO., LTD., Seoul (KR)

( * ) Notice: Subject to any disclaimer, the term of this patent is extended or adjusted under 35 U.S.C. 154(b) by 899 days.

This patent is subject to a terminal disclaimer.

(21) Appl. No.: 16/503,221

(22) Filed: Jul. 3, 2019

(65) Prior Publication Data

US 2020/0015020 A1 Jan. 9, 2020

(30) Foreign Application Priority Data

Jul. 3, 2018 (KR) ..... 10-2018-0076979

(51) Int. Cl.
*H04R 7/02* (2006.01)
*H04R 19/04* (2006.01)
*H04R 31/00* (2006.01)

(52) U.S. Cl.
CPC ..... *H04R 19/04* (2013.01); *H04R 7/02* (2013.01); *H04R 31/00* (2013.01); *H04R 2201/003* (2013.01)

(58) Field of Classification Search
CPC ..... H04R 19/005; H04R 19/04; H04R 7/02; H04R 31/00; H04R 2201/003
USPC ..... 381/175
See application file for complete search history.

(56) References Cited

U.S. PATENT DOCUMENTS 8,942,394 B2 * 1/2015 Conti ..... H04R 31/00 381/174
2014/0374859 A1 * 12/2014 Kasai ..... B81B 7/0064 257/419
2017/0311083 A1 10/2017 Sun et al.
2017/0311088 A1 10/2017 Sun et al.
2017/0311089 A1 10/2017 Sun et al.
2017/0359648 A1 12/2017 Park et al.
2019/0047849 A1 2/2019 Park et al.
2019/0052976 A1 2/2019 Sun
2019/0082269 A1 3/2019 Sun
2019/0082270 A1 3/2019 Sun
2019/0082271 A1 3/2019 Kim et al.
2020/0322732 A1 * 10/2020 Lee ..... H04R 31/00

* cited by examiner

*Primary Examiner* — Suhan Ni
(74) *Attorney, Agent, or Firm* — Patterson Thuente IP

(57) ABSTRACT

A MEMS microphone includes a substrate having a cavity, a diaphragm disposed over the substrate to cover the cavity, an anchor extending from and end portion of the diaphragm to surround a periphery of the diaphragm, the anchor being fixed to a lower surface of the substrate to support the diaphragm from the substrate, a back plate disposed over the diaphragm, the back plate being spaced apart from the diaphragm to define an air gap therebetween and having a plurality of acoustic holes, an upper insulation layer covering an upper surface of the back plate to hold the back plate, and a strut positioned on the anchor, the strut being connected to the upper insulation layer and making contact with a lower surface of the anchor to support the upper insulation layer and to be spaced from the diaphragm.

10 Claims, 9 Drawing Sheets

MEMS MICROPHONE AND METHOD OF MANUFACTURING THE SAME

CROSS-REFERENCE TO RELATED APPLICATION

This application claims priority to Korean Patent Application No. 10-2018-0076979, filed on Jul. 3, 2018, and all the benefits accruing therefrom under 35 U.S.C. § 119, the contents of which are incorporated by reference in their entirety.

TECHNICAL FIELD

The present disclosure relates to a Micro Electro Mechanical Systems (MEMS) microphone capable of converting an acoustic wave into an electrical signal and a method of manufacturing the same. More particularly, the present disclosure relates to a capacitive MEMS microphone being capable of transforming the acoustic wave into the electric signal using a displacement of a diaphragm which occurs due to an acoustic pressure, and a method of manufacturing such a MEMS microphone.

BACKGROUND

Generally, a capacitive microphone utilizes a capacitance measured between a pair of electrodes which are facing each other to detect an acoustic wave to output an electrical signal. The capacitive microphone may be manufactured through semiconductor MEMS processes to achieve a MEMS microphone having an ultra-small size.

The capacitive microphone includes a diaphragm being configured to be bendable and a back plate facing the diaphragm. The diaphragm is spaced apart from a substrate and the back plate to be freely bendable upwardly or downwardly in accordance with the acoustic wave. The diaphragm may have a membrane structure to perceive an acoustic pressure to generate a displacement. In particular, when the acoustic pressure is applied to the diaphragm, the diaphragm may be bent upwardly or downwardly due to the acoustic pressure. The displacement of the diaphragm may be perceived through a value change of capacitance defined between the diaphragm and the back plate. As a result, an acoustic wave may be converted into an electrical signal such that the electrical signal may be outputted.

The MEMS microphone has various characteristics such as a frequency resonance, a pull-in voltage, a Total Harmonic Distortion, a sensitivity, a signal to noise ratio (hereinafter, referred as "SNR"), etc.

In particular, when the MEMS microphone is applied to a high-end mobile device, it may be required for the MEMS microphone to have improved an SNR property. In order to improve the SNR property, it may be much more effective to increase a size of the diaphragm than several factors.

According to the conventional structure of the MEMS microphone, the MEMS microphone may include an anchor surrounding a circumference of the diaphragm and being configured to support the diaphragm from the substrate, and a strut of making an upper insulation layer for holding the back plate spaced from the diaphragm. However, since the anchor is apart from the chamber, it may be limited to increase the size of the diaphragm beyond the chamber. That is because the strut may occlude some area of the substrate.

SUMMARY

The example embodiments herein provide a MEMS microphone capable of having an enlarged size of a diaphragm to improve an SNR property.

The example embodiments herein provide a method of manufacturing a MEMS microphone capable of having an enlarged size of a diaphragm to improve an SNR property.

According to some example embodiments of the present invention, a MEMS microphone includes a substrate having a cavity, a diaphragm disposed over the substrate to cover the cavity, the diaphragm being spaced apart from the substrate and being configured to sense an acoustic pressure to generate a displacement, an anchor extending from and end portion of the diaphragm to surround a periphery of the diaphragm, the anchor being fixed to a lower surface of the substrate to support the diaphragm from the substrate, a back plate disposed over the diaphragm, the back plate being spaced apart from the diaphragm to define an air gap therebetween and having a plurality of acoustic holes, an upper insulation layer covering an upper surface of the back plate to hold the back plate, and a strut positioned on the anchor, the strut being connected to the upper insulation layer and making contact with a lower surface of the anchor to support the upper insulation layer and to be spaced from the diaphragm.

In an example embodiment, the anchor may have a ring shape to surround the cavity, and the strut may have a ring shape to surround the diaphragm.

In an example embodiment, the strut may have a width smaller than that of the anchor to make the strut stably positioned on the anchor.

In an example embodiment, the diaphragm may include a plurality of vent holes penetrating therethrough, the vent holes being arranged along a periphery of the diaphragm and being spaced apart from each other.

In an example embodiment, the anchor may be formed integrally with the diaphragm.

According to some example embodiments of the present invention, a MEMS microphone includes a substrate being divided into a vibration area, a supporting area surrounding the vibration area and a peripheral area surrounding the supporting area, the substrate having a cavity formed in the vibration area, a diaphragm disposed over the substrate to cover the cavity, the diaphragm being spaced apart from the substrate and being configured to sense an acoustic pressure to generate a displacement, an anchor extending from and end portion of the diaphragm, being positioned in the supporting area and surrounding a periphery of the diaphragm, the anchor being fixed to a lower surface of the substrate to support the diaphragm from the substrate, a back plate disposed over the diaphragm and in the vibration area, the back plate being spaced apart from the diaphragm to define an air gap therebetween and having a plurality of acoustic holes, an upper insulation layer covering the back plate to hold the back plate, and a strut positioned on the anchor and in the supporting area, the strut being connected to the upper insulation layer and making contact with a lower surface of the anchor to support the upper insulation layer and to be spaced from the diaphragm.

In an example embodiment, the anchor may have a ring shape to surround the cavity, and the strut may have a ring shape to surround the diaphragm.

In an example embodiment, the strut may have a width smaller than that of the anchor to stably position the strut on the anchor.

In an example embodiment, the diaphragm may include a plurality of vent holes penetrating therethrough, the vent holes being arranged along a periphery of the diaphragm and being spaced apart from each other.

In an example embodiment, the anchor may be formed integrally with the diaphragm.

According to some example embodiments of the present invention, a MEMS microphone is manufactured by forming a lower insulation layer on a substrate defining a vibration area, a supporting area surrounding the vibration area, and a peripheral area surrounding the supporting area, forming a diaphragm and an anchor for supporting the diaphragm on the lower insulation layer, forming a sacrificial layer on the lower insulation layer to cover the diaphragm, forming a back plate on the sacrificial layer and in the vibration area to face the diaphragm, forming an upper insulation layer on the sacrificial layer to cover the back plate, and a strut on the anchor to make the upper insulation layer spaced form the diaphragm, the upper insulation layer holding the back plate to make the back plate space apart from the diaphragm, patterning the back plate to form a plurality of acoustic holes penetrating through the back plate, patterning the substrate to form a cavity to partially expose the lower insulation layer in the vibration region, and performing an etch process using the cavity and the acoustic holes to remove portions of the lower insulation layer and the sacrificial layer in the vibration area and the supporting area.

In an example embodiment, forming the diaphragm and the anchor may include patterning the lower insulation layer to form an anchor channel in the supporting area for forming the anchor, forming a silicon layer on the lower insulation layer to cover the anchor channel, and patterning the silicon layer to form the diaphragm and the anchor.

In an example embodiment, wherein forming the diaphragm and the anchor may include forming a plurality of vent holes penetrating through the diaphragm in the vibration area.

In an example embodiment, the vent holes may serve as a pathway through which etchant flows while removing the portions of the lower insulation layer and the sacrificial layer in the vibration area and the supporting area.

In an example embodiment, wherein forming the acoustic holes penetrating through the back plate may include patterning the upper insulation layer in the vibration area such that the acoustic holes penetrate through the back plate and the upper insulation layer.

In an example embodiment, forming the upper insulation layer and the strut may include patterning the sacrificial layer to form a strut channel along the supporting area to expose an upper surface of the anchor, and forming an insulation layer on the sacrificial layer to cover the back plate and the strut channel.

In an example embodiment, the insulation layer may be made of a material different from those of the lower insulation layer and the sacrificial layer, such that the insulation layer has an etching selectivity against the lower insulation layer and the sacrificial layer, and the strut may prevent etchant from diffusing into the peripheral region, while removing the lower insulation layer and the sacrificial layer in the vibration region and the supporting region using etchant.

According to some example embodiments, the MEMS microphone includes the strut overlapped with the anchor such that the diameter of the anchor may increase by the size of the strut. Therefore, the size of the diaphragm may increase as much as the diaphragm of the strut. Since the diaphragm has an increased size, the SNR property of the MEMS microphone may be improved.

In addition, the anchor may extend along the circumference of the diaphragm 120 and is provided in a ring shape. Therefore, in the manufacturing process of the MEMS microphone, the anchor may function to define a moving region of the etchant, so that the process margin may be secured compared with the conventional art.

In addition, since the diaphragm includes the vent holes that may be provided as a pathway for moving the acoustic wave and the etchant, the acoustic wave may move more smoothly and the process efficiency may be improved.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Exemplary embodiments can be understood in more detail from the following description taken in conjunction with the accompanying drawings, in which.

Figure 1:
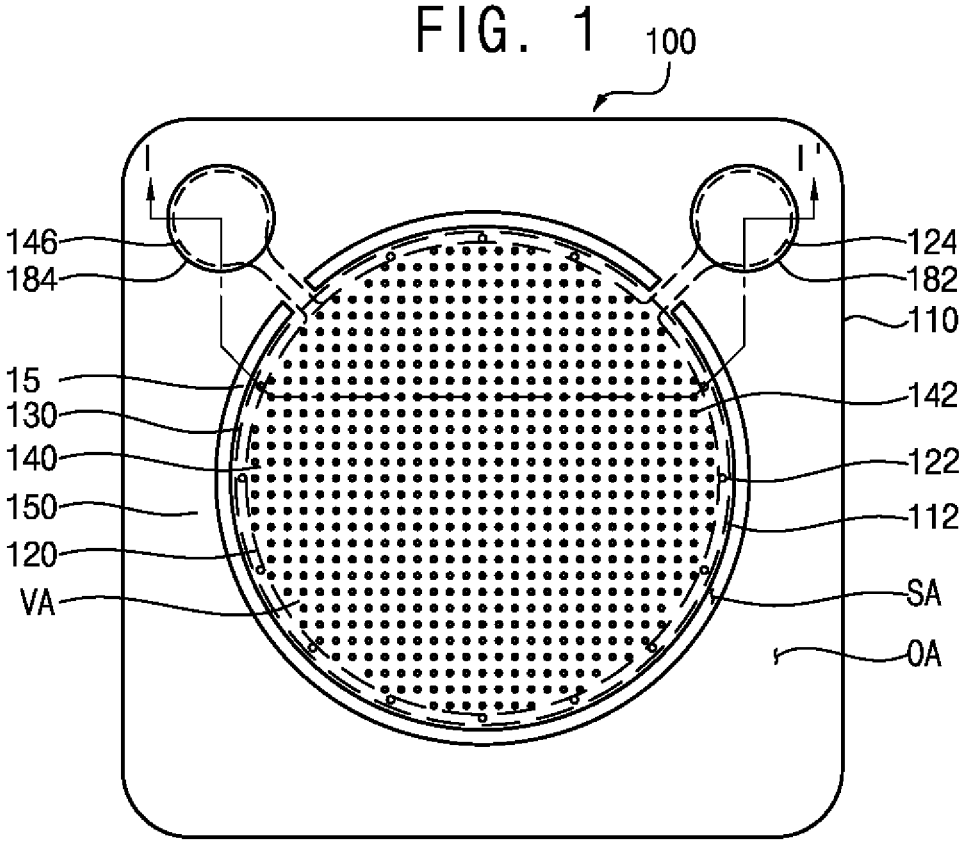
FIG. 1 is a plan view illustrating a MEMS microphone in accordance with an embodiment of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF EMBODIMENTS

Hereinafter, specific embodiments will be described in more detail with reference to the accompanying drawings. The present invention may, however, be embodied in different forms and should not be construed as limited to the embodiments set forth herein.

As an explicit definition used in this application, when a layer, a film, a region or a plate is referred to as being 'on' another one, it can be directly on the other one, or one or more intervening layers, films, regions or plates may also be present. Unlike this, it will also be understood that when a layer, a film, a region or a plate is referred to as being 'directly on' another one, it is directly on the other one, and one or more intervening layers, films, regions or plates do not exist. Also, though terms like a first, a second, and a third are used to describe various components, compositions, regions and layers in various embodiments of the present invention are not limited to these terms.

Furthermore, and solely for convenience of description, elements may be referred to as "above" or "below" one another. It will be understood that such description refers to the orientation shown in the Figure being described, and that in various uses and alternative embodiments these elements could be rotated or transposed in alternative arrangements and configurations.

In the following description, the technical terms are used only for explaining specific embodiments while not limiting the scope of the present invention. Unless otherwise defined herein, all the terms used herein, which include technical or scientific terms, may have the same meaning that is generally understood by those skilled in the art.

The depicted embodiments are described with reference to schematic diagrams of some embodiments of the present invention. Accordingly, changes in the shapes of the diagrams, for example, changes in manufacturing techniques and/or allowable errors, are sufficiently expected. Accordingly, embodiments of the present invention are not described as being limited to specific shapes of areas described with diagrams and include deviations in the shapes and also the areas described with drawings are entirely schematic and their shapes do not represent accurate shapes and also do not limit the scope of the present invention.

Figure 2:
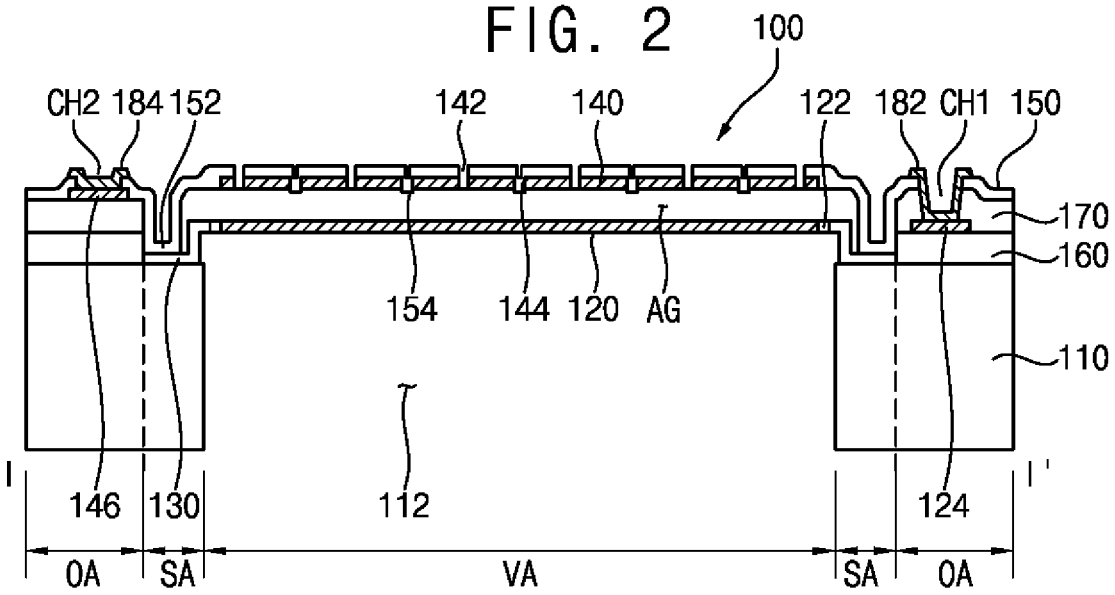
FIG. 2 is a cross sectional view taken along a line I-I' in FIG. 1.

FIG. 1 is a plan view illustrating a MEMS microphone in accordance with an embodiment of the present invention. FIG. 2 is a cross sectional view taken along a line I-I' in FIG. 1.

Referring to FIGS. 1 and 2, a MEMS microphone 100 in accordance with an example embodiment of the present invention includes a substrate 110, a diaphragm 120, an anchor 130 and a back plate 140. The MEMS microphone 100 may generate a displacement in accordance with an acoustic pressure to transform the acoustic pressure into an electric signal to be outputted.

The substrate 110 is divided into a vibration area VA, a supporting area SA surrounding the vibration area VA, and a peripheral area OA surrounding the supporting area SA. In the vibration area VA, a cavity 112 is formed. The cavity 112 may penetrate through the substrate 110 in a vertical direction. The cavity 112 may provide a space in order for the diaphragm 120 to be downwardly bendable (i.e., bendable into the cavity 112) when an acoustic pressure is applied.

For example, the cavity 112 may have a cylindrical column shape. The cavity 112 may have a planar size corresponding to that of the vibration area VA.

The diaphragm 120 may be positioned over the substrate 110. The diaphragm 120 may have a membrane structure. The diaphragm 120 detects the acoustic pressure to generate the displacement. The diaphragm 120 is disposed to cover the cavity 112. The diaphragm 120 may have a lower face exposed through the cavity 112. The diaphragm 120 is spaced apart from the substrate 110 to be configured to be downwardly bendable with responding to the acoustic pressure.

The diaphragm 120 may have an ion implantation region into which impurities such III element or V elements are doped. The ion implantation region may face the back plate 140.

In an example embodiment, the diaphragm 120 may have a ring shape.

The anchor 130 is adjacent to a peripheral portion of the diaphragm 120. The anchor 130 is disposed in the supporting area SA to support the diaphragm 120 from the substrate 110. The anchor 130 may extend along the peripheral portion of the diaphragm 120. The anchor 130 may extend from the periphery of the diaphragm 120 toward the substrate 110 to make the diaphragm 120 spaced apart from the substrate 110.

In one example, the anchor 130 is formed integrally with the diaphragm 120. The anchor 130 has a lower surface of making contact with an upper surface of the substrate 110 to be fixed to the substrate 110.

Further, the anchor 130 may have a ring shape and surround the cavity 112. The anchor 130 may have an "L" vertical sectional shape or an "U" vertical sectional shape.

The diaphragm 120 may have a plurality of vent holes 122. The vent holes 122 may be spaced apart from each other and be arranged along the anchor 130 in a ring shape. The vent holes 122 may penetrate through the diaphragm 120 to communicate with the cavity 112. Particularly, the vent holes 122 may serve as a pathway through which the acoustic wave flows, or may be provided for a pathway through which etchant flows in process for manufacturing the MEMS microphone 100.

The vent holes 122 may be positioned in the vibration area VA. The vent holes 122 may be disposed either around a boundary region between the vibration area VA and the supporting area SA or in the supporting area SA adjacent to the vibration area VA.

The back plate 140 is disposed over the diaphragm 120. The back plate 140 may be positioned in the vibration area VA. The back plate 140 is spaced apart from the diaphragm 120 and is provided to face the diaphragm 120. The back plate 140 may be doped with impurities by implanting the impurities through an ion-implanting process. Like the diaphragm 120, the back plate 140 may have a ring shape.

In an example embodiment, the MEMS microphone 100 may further include an upper insulation layer 150 and a strut 152 for supporting the back plate 140 from the substrate 110.

In particular, the upper insulation layer 150 is positioned over the substrate 110 over which the back plate 140 is positioned. The upper insulation layer 150 may cover the back plate 140 to hold the back plate 140. Thus, the upper insulation layer 150 may space the back plate 140 from the diaphragm 120.

As shown in FIG. 2, the back plate 140 and the upper insulation layer 150 are spaced apart from the diaphragm 120 to make the diaphragm 120 freely bendable in response to the acoustic pressure. Further, an air gap AG is formed between the diaphragm 120 and the back plate 140.

A plurality of acoustic holes 142 may be formed through the back plate 140 such that the acoustic wave may direct through the acoustic holes 142. The acoustic holes 142 may be formed through the upper insulation layer 150 and the back plate 140 to communicate with the air gap AG.

Further, the back plate 140 may include a plurality of dimple holes 144. Further, a plurality of dimples 154 may be positioned in the dimple holes 144. The dimple holes 144 may be formed through the back plate 140. The dimples 154 may be positioned to correspond to positions at which the dimple holes 144 are formed.

The dimples 154 may prevent the diaphragm 120 from being coupled to a lower face of the back plate 140. That is, when the acoustic pressure reaches to the diaphragm 120, the diaphragm 120 can be bent in a semicircular shape toward the back plate 140, and then can return to its initial position. A bending degree of the diaphragm 120 may vary depending on a magnitude of the acoustic pressure and may be increased to such an extent that an upper surface of the diaphragm 120 makes contact with the lower surface of the back plate 140. When the diaphragm 120 is bent so much as to contact the back plate 140, the diaphragm 120 may attach to the back plate 140 and may not return to the initial position. According to example embodiments, the dimples 154 may protrude from the lower surface of the back plate 140 toward the diaphragm 120. Even when the diaphragm 120 is severely bent so much that the diaphragm 120 contacts the back plate 140, the dimples 154 may separate the diaphragm 120 and the back plate 140 so that the diaphragm 120 can return to the initial position.

In the meantime, the strut 152 may be positioned in the supporting area SA and adjacent to a boundary region between the supporting area SA and the peripheral area OA. The strut 152 may support the upper insulation layer 150 to space both the upper insulation layer 150 and the back plate 140 from the diaphragm 120. The strut 152 may have a ring shape to surround the diaphragm 120. As shown in FIG. 2, the strut 152 may have a lower surface to make contact with the upper surface of the anchor 130.

As depicted in FIG. 2, the strut 152 may have a "U" vertical sectional shape. The strut 152 may formed integrally with the upper insulation layer 150.

The strut 152 may be spaced apart from the diaphragm 120 and may be positioned on the anchor 130. The strut 152 may have a ring shape and may surround the diaphragm 120.

A width of the strut 152 may be smaller than that of the anchor 130. Further, the strut 152 may be overlapped with the anchor 130 in a vertical direction to make the strut 152 stably positioned on the anchor 130.

Since the strut 152 and the anchor 130 are vertically overlapped with each other, a width of the support region SA may be reduced, and the diameter of the anchor 130 may increase to be same as the diameter of the strut 152.

Therefore, a width of the vibration area VA may be increased as the width of the support area SA is decreased. The width of the vibration area VA is increased and the diameter of the anchor 130 is increased. As a result, the size of the diaphragm 120 may be increased while the size of the MEMS microphone 100 is kept constant. Since the size of the diaphragm 120 is increased in comparison with the conventional art, the SNR property of the MEMS microphone 100 may be improved.

In an example embodiment, the MEM microphone 100 may further include a lower insulation layer 160, a sacrificial layer 170, a diaphragm pad 124, a back plate pad 146, a first pad electrode 182 and a second pad electrode 184.

In particular, the lower insulation layer 160 may be disposed on the upper surface of the substrate 110 and under the upper insulation layer 150.

The diaphragm pad 124 may be disposed on the upper face of the lower insulation layer 160 and in the peripheral area OA. The diaphragm pad 124 may be electrically connected to the diaphragm 120. The diaphragm pad 124 may be doped with impurities by an ion-implanting process. Even though not shown in detail, a connection porting of connecting the diaphragm 120 with the diaphragm pad 124 may be doped with impurities as well.

The sacrificial layer 170 may be disposed on the lower insulation layer 160 to cover the diaphragm pad 124. Further, the sacrificial layer 170 is disposed beneath the upper insulation layer 150. The lower insulation layer 160 and the sacrificial layer 170 are located in the peripheral area OA. Here, the lower insulation layer 160 and the sacrificial layer 170 may be located outside from the strut 152 in a plan view. Further, the lower insulation layer 160 and the sacrificial layer 170 may be formed using materials different from each other.

The back plate pad 146 may be formed on an upper face of the sacrificial layer 170 and in the peripheral area OA. The back plate pad 146 is electrically connected to the back plate 140 and may be formed with impurities by an ion implanting process. Even though not shown in detail, a connection porting of connecting the back plate 140 with the back plate pad 146 may be doped with impurities as well.

The first and second pad electrodes 182 and 184 may be formed on the upper insulation layer 150 and in the peripheral area OA. The first pad electrode 182 makes contact with the diaphragm pad 124 to be electrically connected to the diaphragm pad 124. On the other hand, the second pad electrode 184 makes contact with the back plate pad 146 to be electrically connected to the back plate pad 146. As shown in FIG. 2, the diaphragm pad 124 is exposed through a first contact hole CH formed by partially removing the upper insulation layer 150 and the sacrificial layer 170 such that the first pad electrode 182 makes contact with the diaphragm pad 124 through the first contact hole CH1. Further, the back plate pad 146 is exposed through a second contact hole CH2 formed by partially removing the upper insulation layer 150 such that the second pad electrode 184 makes contact with the back plate pad 146 through the second contact hole CH2.

According to some example embodiment, the MEMS microphone 100 includes the strut 152 disposed on the anchor 130 to make overlapped with the anchor 130 such that the size of the diaphragm 120 may be increased. Therefore, the signal-to-noise ratio (SNR) property of the MEMS microphone 100 may be improved.

In addition, the anchor 130 extends along the circumference of the diaphragm 120 and is provided in a ring shape. Therefore, in the manufacturing process of the MEMS microphone 100, the anchor 130 may function to define a moving region of the etchant, so that the process margin may be secured compared with the conventional art.

In addition, since the diaphragm 120 includes the vent holes 122 that may be provided as a pathway for moving the acoustic wave and the etchant, the acoustic wave may move more smoothly and the process efficiency may be improved.

Hereinafter, a method of manufacturing a MEMS microphone 100 will be described in detail with reference to the drawings.

Figure 3:
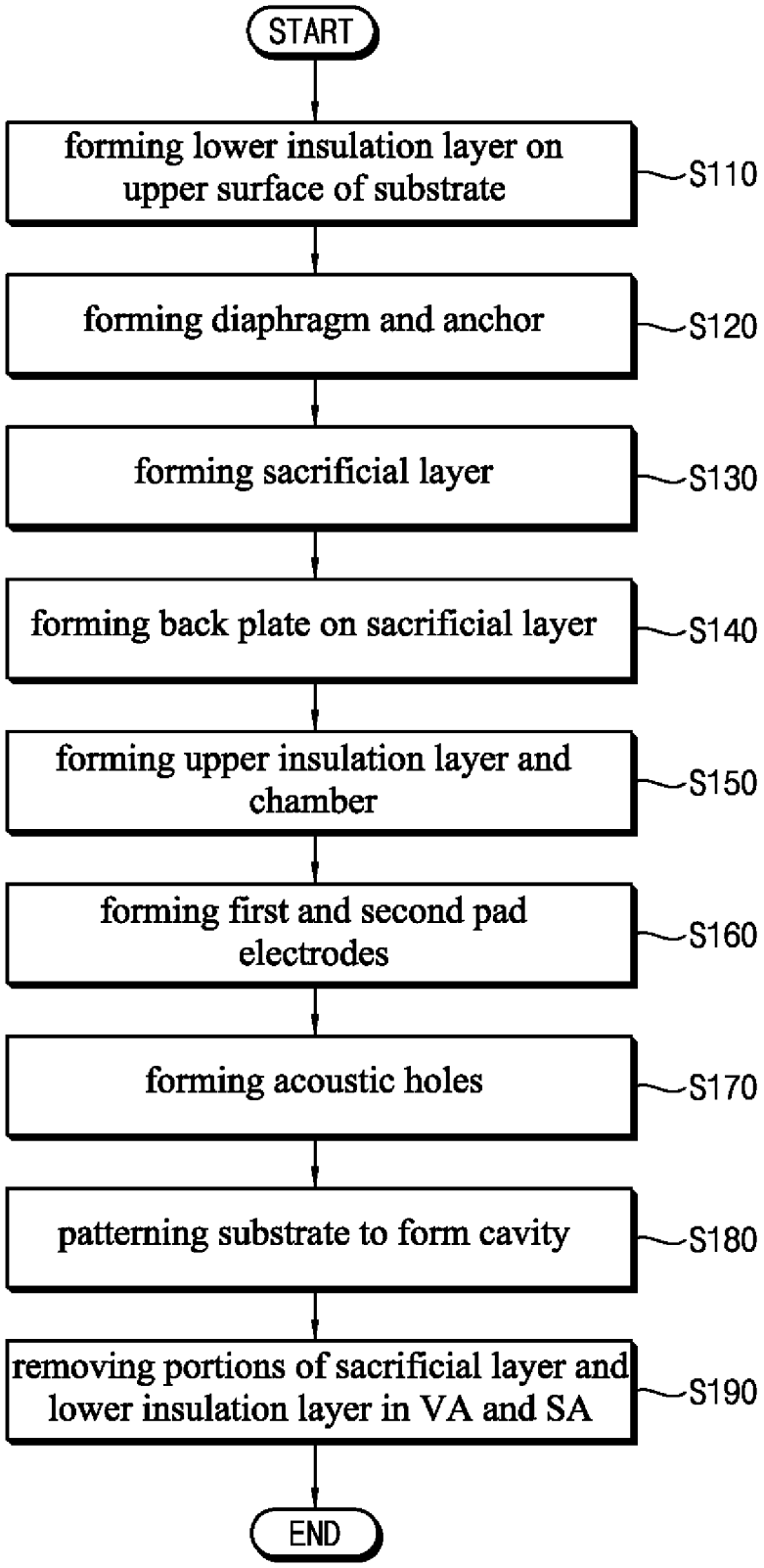
FIG. 3 is a flow chart illustrating a method of manufacturing a MEMS microphone in accordance with an embodiment of the present invention.

FIG. 3 is a flow chart illustrating a method of manufacturing a MEMS microphone in accordance with an example embodiment of the present invention. FIGS. 4 to 14 are cross sectional views illustrating a method of manufacturing a MEMS microphone in accordance with an example embodiment of the present invention.

Referring to FIGS. 3 and 4 to 6 according to an example embodiment of a method for manufacturing a MEMS microphone, a lower insulation layer 160 is formed on a substrate 110 (S110).

Next, a diaphragm 120 and an anchor 130 are formed on the lower insulation layer 160 (S120).

Processes of forming the diaphragm 120 and the anchor 130 will be explained in detail as below.

Figure 4:
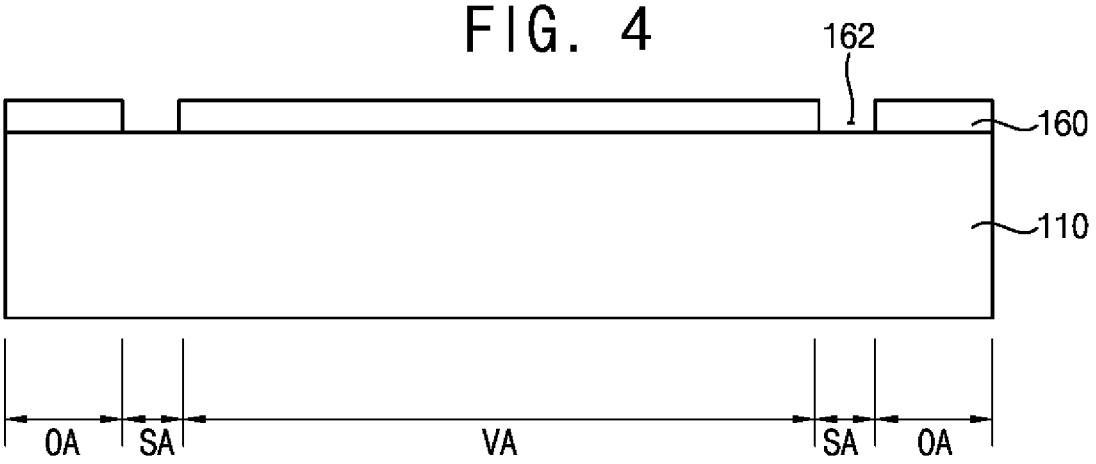
FIGS. 4 to 14 are cross sectional views illustrating a method of manufacturing a MEMS microphone in accordance with an embodiment of the present invention.

As shown in FIG. 4, the lower insulation layer 150 is patterned to form an anchor channel 162 for forming the anchor 130. The substrate 110 may be partially exposed through the anchor channel 162. The anchor channel 162 is formed in a supporting area SA, and is formed to surround a vibration area VA and to have a ring shape.

Figure 5:
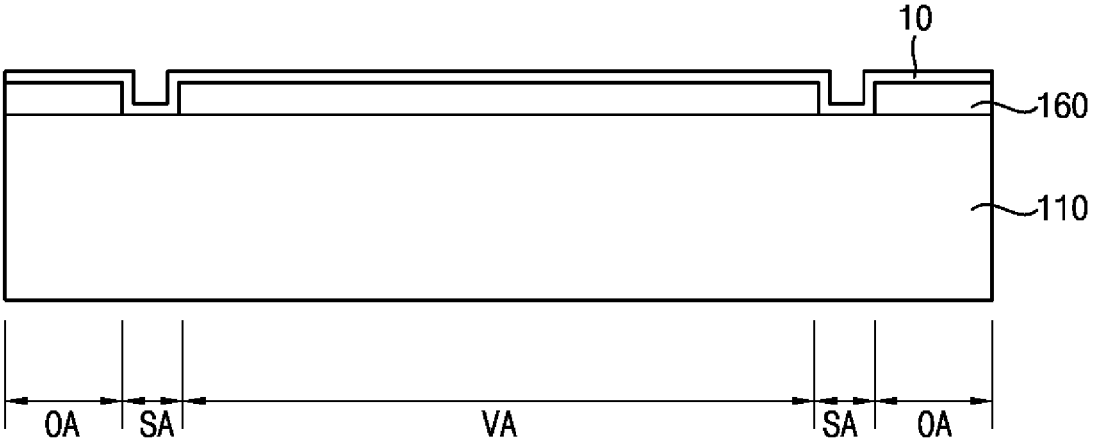

Next, as shown in FIG. 5, a first silicon layer 10 is formed on the lower insulation layer 160 to cover the anchor channel 162. The first silicon layer 10 may be formed using polysilicon by a chemical vapor deposition process.

Further, impurities may be doped into the vibration area VA of the first silicon layer 10 through an ion implanting process for forming a diaphragm 120 having a relatively low resistance in the vibration area VA and a diaphragm pad 124 in the peripheral area OA in a subsequent patterning process.

Figure 6:
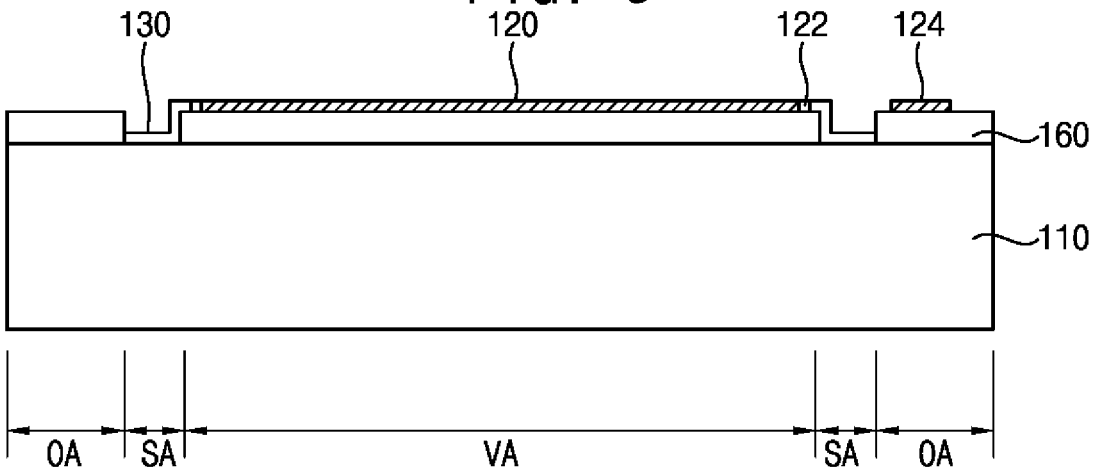

Next, as shown in FIG. 6, the first silicon layer 10 is patterned to form the diaphragm 120 in the vibration area VA, the anchor 130 in the supporting area SA, and the diaphragm pad 124 in the peripheral area OA. The anchor 130 is disposed in the supporting area SA. The anchor 130 may extend along the peripheral portion of the diaphragm 120. The anchor 130 may have a ring shape. The anchor 130 may have an "L" vertical sectional shape or a "U" vertical sectional shape.

A plurality of vent holes 122 is formed through the diaphragm 120. The vent holes 122 are formed in the vibration area VA.

Alternatively, the vent holes 122 may be disposed either around a boundary region between the vibration area VA and the supporting area SA or in the supporting area SA adjacent to the vibration area VA.

Figure 7:
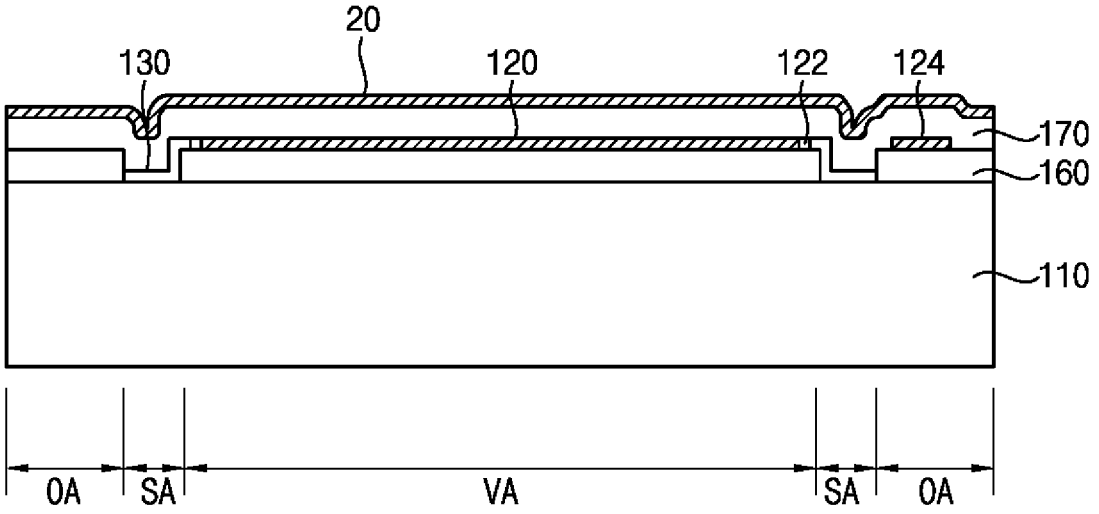
Figure 8:
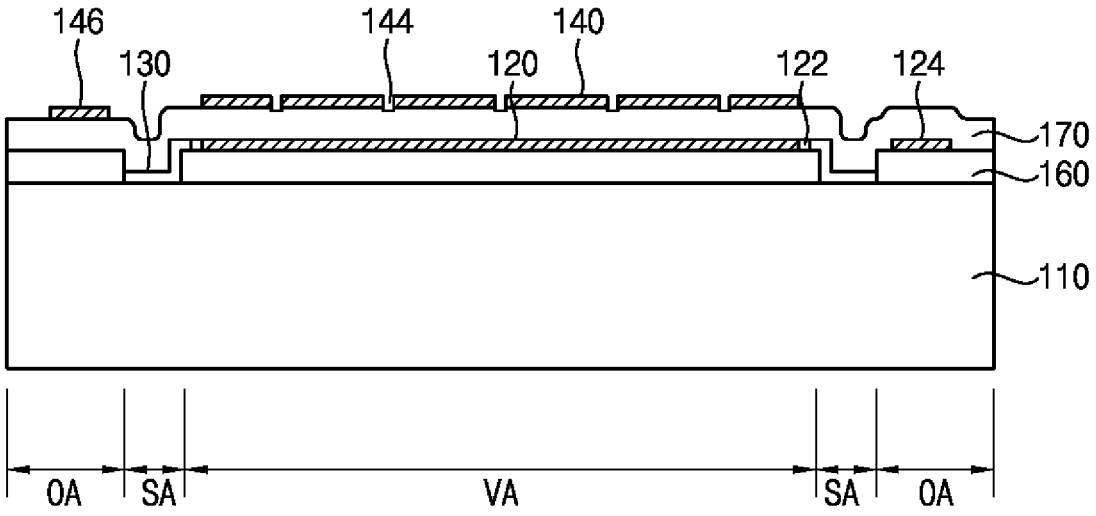

Referring to FIGS. 3, 7 and 8, a sacrificial layer 170 is formed on the lower insulation layer 160 to cover the diaphragm 120 (S130).

Next, a back plate 140 is formed on the sacrificial layer 170 (S140).

In particular, a second silicon layer 20 is formed on the sacrificial layer 170 and then, the second silicon layer 20 is doped with impurities by an ion implanting process. Here, the second silicon layer 20 may be formed using polysilicon.

Then, the second silicon layer 20 is patterned to form a back plate 140 and a back plate pad 146. Dimple holes 144 are further formed through the back plate 140 in the vibration area VA for forming dimples 154 (see FIG. 2), whereas acoustic holes 142 (see FIG. 2) are not formed. Further, a portion of the sacrificial layer 170, which corresponds to the dimple holes 144, may be further etched in order for the dimples 154 to protrude from a lower face of the back plate 140 in a subsequent process.

Figure 9:
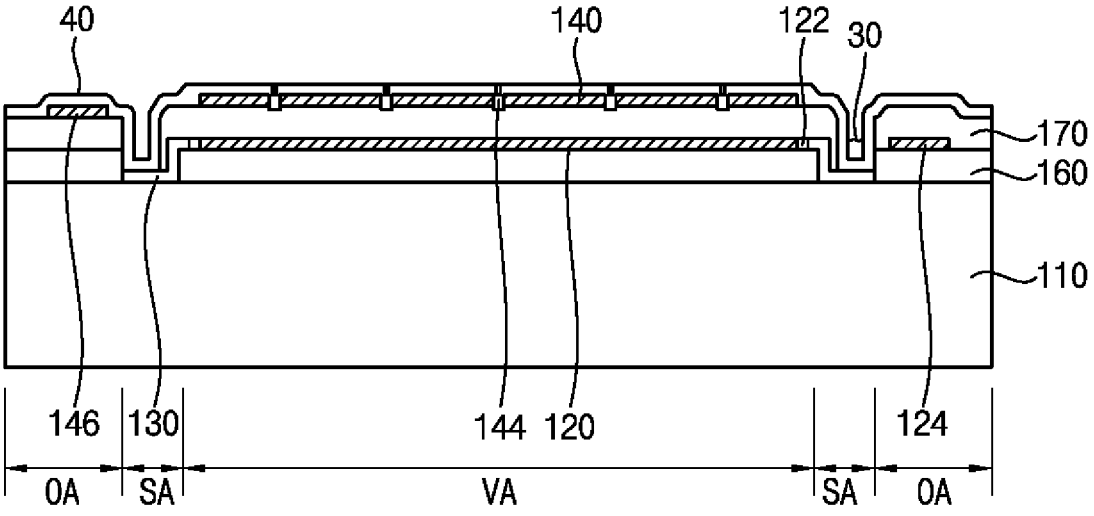
Figure 10:
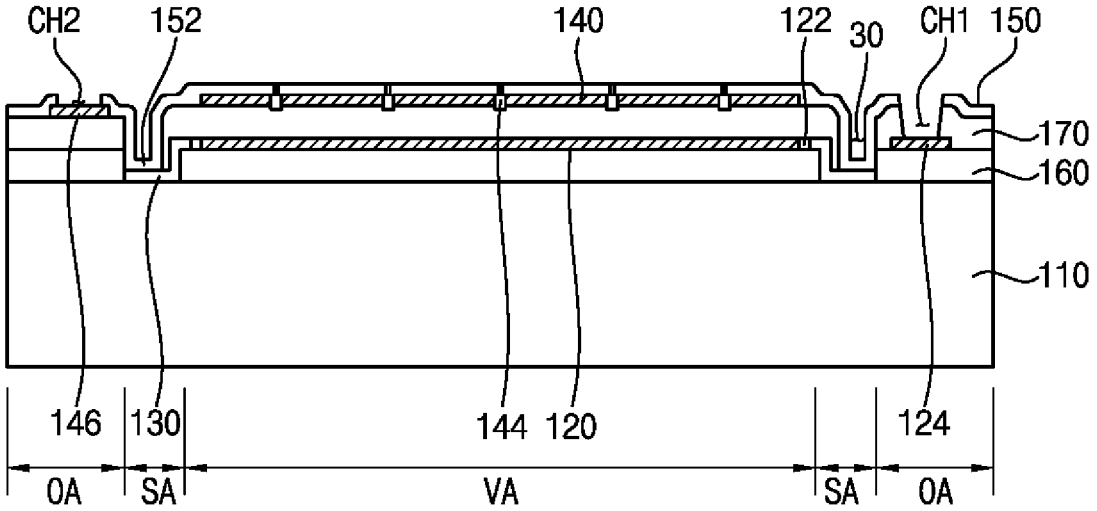

Referring to FIGS. 3, 9 and 10, an upper insulation layer 150 and a strut 152 are formed on the sacrificial layer 170 to cover the back plate 140 (S150).

In detail, as shown in FIG. 9, the sacrificial layer 170 is patterned to form a strut channel 30 in the supporting area SA for forming a strut 152. The anchor 130 may be partially exposed through the strut channel 30. The strut channel 30 may have a width smaller than that of the anchor 130.

Even though not depicted in detail in the drawings, the strut channel 30 may have a ring shape to surround the diaphragm 120.

Then, an insulation layer 40 is formed on the sacrificial layer 170 to cover a sidewall and a bottom of the strut channel 30.

In an example embodiment, the insulation layer 40 is formed of a material different from those of the lower insulation layer 160 and the sacrificial layer 170. For example, the insulation layer 40 may be formed of a silicon nitride material, and the lower insulation layer 160 and the sacrificial layer 170 may be formed of a silicon oxide material.

Referring to FIG. 10, the insulation layer 40 (not labeled in this view, but see FIG. 9) is patterned to form the upper insulation layer 150 and the strut 152. Further, the dimples 154 may be further formed in the dimple holes 144, and a second contact hole CH2 is formed in the peripheral area OA to expose the back plate pad 146. Furthermore, portions of the insulation layer 40 and the sacrificial layer 170, which are positioned over the diaphragm pad 124, are etched to form a first contact hole CH1 in the peripheral area OA.

In addition, the strut 152 may be located on the anchor 130 away from the diaphragm 120. The strut 152 may have a ring shape and may be disposed to surround the diaphragm 120.

The anchor 130 and the strut 152 are vertically overlapped with each other. Accordingly, a width of the support region SA may be reduced, and a diameter of the anchor 130 may increase as much as a diameter of the strut 152. Since the diameter of the anchor 130 is increased, the size of the diaphragm 120 may be increased while maintaining a larger size of the MEMS microphone 100. Since the size of the diaphragm 120 may increase in comparison with the conventional art, the signal-to-noise ratio (SNR) property of the MEMS microphone 100 may be improved.

Figure 11:
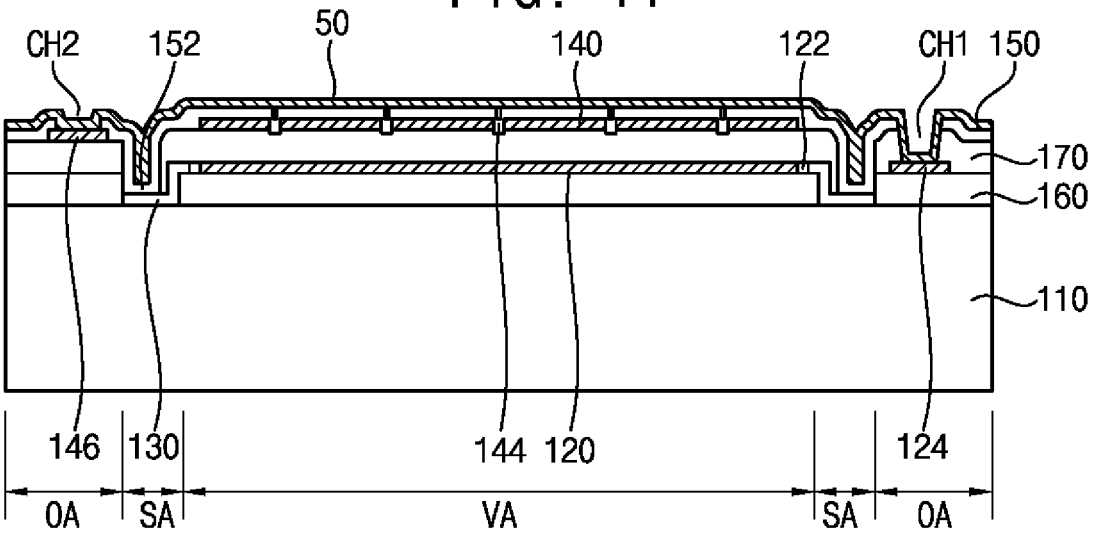
Figure 12:
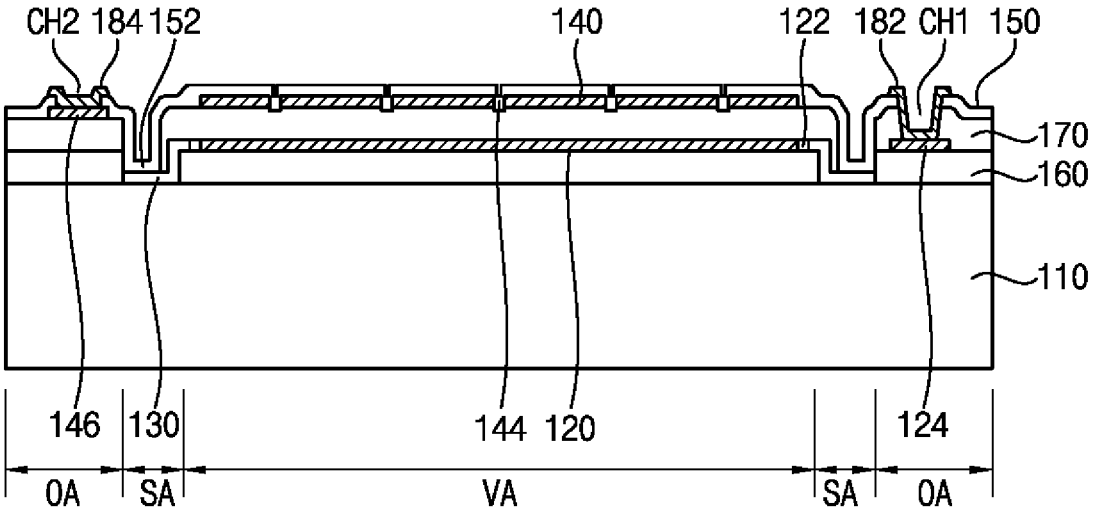

Referring to FIGS. 3, 11 and 12, after the first and second contact holes CH1 and CH2 are formed, first and second pad electrodes 182 and 184 are formed in the peripheral region OA (S160).

As shown in FIG. 11, a thin film 50 is formed on the upper insulation layer 150 on which the first and second contact holes CH1 and CH2 are formed. Here, the thin film 50 may be made of a metal.

Next, as shown in FIG. 12, the thin film 50 is patterned to form the first and second pad electrodes 182 and 184.

Figure 13:
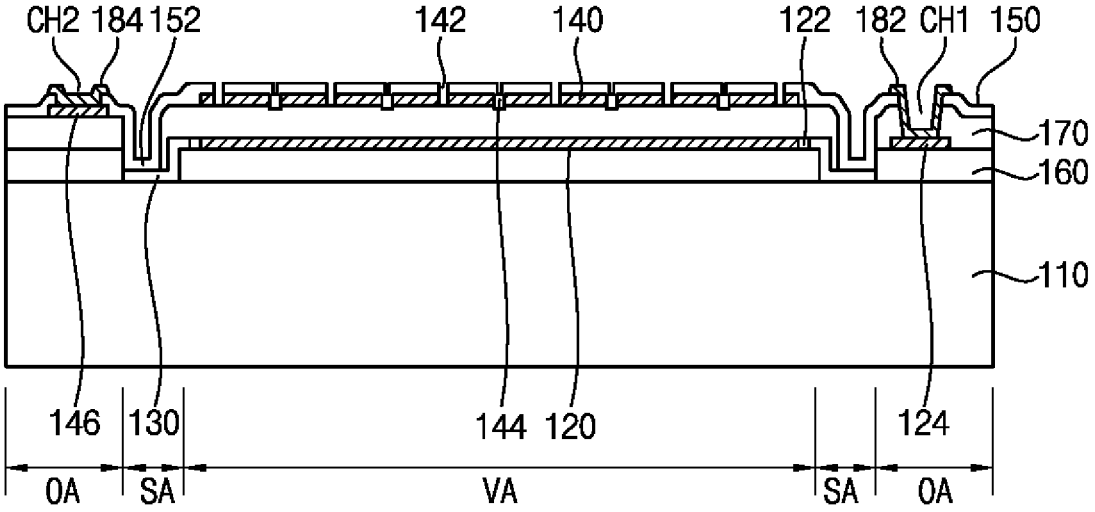

Referring to FIGS. 3 and 13, the upper insulation layer 150 and the back plate 140 are patterned to form acoustic holes 142 in the vibration region VA (S170).

Figure 14:
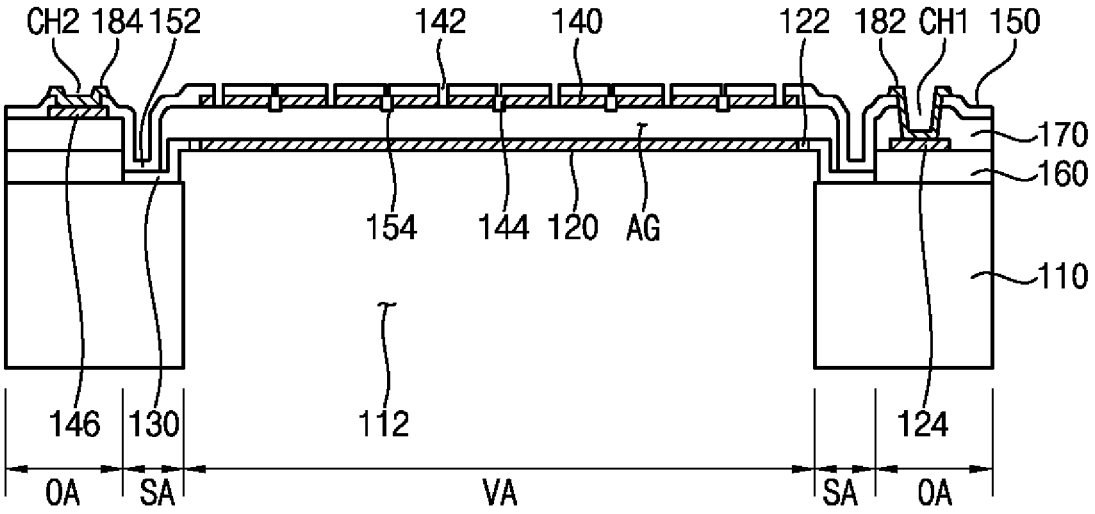

Referring to FIGS. 2, 3 and 14, after forming the acoustic holes 142, the substrate 110 is patterned to form a cavity 112 in the vibration area VA (S180). The lower insulation layer 160 is partially exposed through the cavity 112.

Then, the sacrificial layer 170 and the lower insulation layer 160 are partially etched through an etch process using the cavity 112 and the vent holes 122 (S190). As a result, the diaphragm 120 is exposed through the cavity 112, and an air gap AG between the diaphragm 120 and the back plate 140 is formed. The cavity 112 and the acoustic holes 142 may be provided as pathways for etchant for removing portions of the lower insulation layer 160 and the sacrificial layer 170.

Particularly, while performing S190 of removing the sacrificial layer 170 and the lower insulation layer 160 from the vibration area VA and the supporting area SA, the anchor 130 and the strut 152 may limit the movement of the etchant. Thus, an etch amount of the sacrificial layer 170 and the lower insulation layer 160 may be easily adjusted.

In an example embodiment of the present invention, HF vapor may be used as an etchant for removing the sacrificial layer 170 and the lower insulation layer 160.

As described above, the method of manufacturing the MEMS microphone may include forming the anchor 130 of extending along the periphery of the diaphragm 120 and having the ring shape. Accordingly, the anchor 130 may limit the movement of the etchant to secure a process margin.

In addition, since the etchant may flow through the vent holes 122 of the diaphragm 120, the process efficiency may be improved.

Although the MEM microphone and the method of manufacturing the MEMS microphone have been described with reference to the specific embodiments, they are not limited thereto. Therefore, it will be readily understood by those skilled in the art that various modifications and changes can be made thereto without departing from the spirit and scope of the appended claims.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A MEMS microphone comprising:

a substrate having a cavity;

a diaphragm disposed over the substrate and covering the cavity, the diaphragm spaced apart from the substrate and being configured to sense an acoustic pressure to generate a displacement;

an anchor extending from an end portion of the diaphragm to surround a periphery of the diaphragm, the anchor being fixed to a lower surface of the substrate to support the diaphragm from the substrate;

a back plate disposed over the diaphragm, the back plate being spaced apart from the diaphragm to define an air gap therebetween and defining a plurality of acoustic holes;

an upper insulation layer covering an upper surface of the back plate to hold the back plate; and a strut positioned directly on the anchor, the strut being connected to the upper insulation layer and making contact with a lower surface of the anchor to support the upper insulation layer and to be spaced from the diaphragm.

2. The MEMS microphone of claim 1, wherein the anchor has a ring shape to surround the cavity, and the strut has a ring shape to surround the diaphragm.

3. The MEMS microphone of claim 1, wherein the strut has a width smaller than that of the anchor to make the strut stably positioned on the anchor.

4. The MEMS microphone of claim 1, wherein the diaphragm includes a plurality of vent holes penetrating therethrough, the vent holes being arranged along a periphery of the diaphragm and being spaced apart from each other.

5. The MEMS microphone of claim 1, wherein the anchor is formed integrally with the diaphragm.

6. A MEMS microphone comprising:

a substrate being divided into a vibration area, a supporting area surrounding the vibration area and a peripheral area surrounding the supporting area, the substrate having a cavity formed in the vibration area;

a diaphragm disposed over the substrate to cover the cavity, the diaphragm being spaced apart from the substrate and being configured to sense an acoustic pressure to generate a displacement;

an anchor extending from an end portion of the diaphragm, positioned in the supporting area and surrounding a periphery of the diaphragm, the anchor being fixed to a lower surface of the substrate to support the diaphragm from the substrate;

a back plate disposed over the diaphragm and in the vibration area, the back plate being spaced apart from the diaphragm to define an air gap therebetween and having a plurality of acoustic holes;

an upper insulation layer covering the back plate to hold the back plate; and a strut positioned on the anchor and in the supporting area, the strut being connected to the upper insulation layer and making contact with a lower surface of the anchor to support the upper insulation layer and to be spaced from the diaphragm.

7. The MEMS microphone of claim 6, wherein the anchor has a ring shape to surround the cavity, and the strut has a ring shape to surround the diaphragm.

8. The MEMS microphone of claim 6, wherein the strut has a width smaller than that of the anchor to make the strut stably positioned on the anchor.

9. The MEMS microphone of claim 6, wherein the diaphragm includes a plurality of vent holes penetrating therethrough, the vent holes being arranged along a periphery of the diaphragm and being spaced apart from each other.

10. The MEMS microphone of claim 6, wherein the anchor is formed integrally with the diaphragm.

* * * * *